US011359650B2

(12) United States Patent
Tadje

(10) Patent No.: US 11,359,650 B2
(45) Date of Patent: Jun. 14, 2022

(54) VALVE ARRANGEMENT AND CONTROL METHOD

(71) Applicant: Aventics GmbH, Laatzen (DE)

(72) Inventor: Stefan Tadje, Hannover (DE)

(73) Assignee: Aventics GmbH, Laatzen (DE)

( * ) Notice: Subject to any disclaimer, the term of this patent is extended or adjusted under 35 U.S.C. 154(b) by 299 days.

(21) Appl. No.: 16/755,088

(22) PCT Filed: Oct. 3, 2018

(86) PCT No.: PCT/DE2018/000282
§ 371 (c)(1),
(2) Date: Apr. 9, 2020

(87) PCT Pub. No.: WO2019/072328
PCT Pub. Date: Apr. 18, 2019

(65) Prior Publication Data

US 2020/0240444 A1 Jul. 30, 2020

(30) Foreign Application Priority Data

Oct. 10, 2017 (DE) ..... 102017009374.1

(51) Int. Cl.
*F15B 20/00* (2006.01)
*F15B 11/068* (2006.01)
(Continued)

(52) U.S. Cl.
CPC ..... *F15B 20/008* (2013.01); *F15B 11/068* (2013.01); *F15B 13/0402* (2013.01);
(Continued)

(58) Field of Classification Search
CPC ..... F15B 20/008; F15B 11/068; F15B 2013/041; F15B 2013/0412;
(Continued)

(56) References Cited

U.S. PATENT DOCUMENTS

2003/0010198 A1* 1/2003 Fuss ..... F15B 19/005 92/5 R
2004/0177749 A1* 9/2004 Joergensen ..... A01B 63/1013 91/445

(Continued)

*Primary Examiner* — Kelsey E Cary
(74) *Attorney, Agent, or Firm* — Maginot, Moore & Beck LLP

(57) ABSTRACT

For the purpose of providing a valve arrangement for controlling pneumatic drives with protection against a sudden automatic change in the initial switching position without an input signal in the event of a fault in a resetting device of a pilot stage and, for this situation, effective fault identification by purely pneumatic means, said valve arrangement comprises a first and a second working connection (1; 2), which can be connected to a drive, and a first and a second electropneumatically pilot-controlled directional valve, in which valve arrangement one or both directional valves is or are arranged upstream of the working connections (1; 2) for the purpose of influencing and venting said working connections, wherein the pilot stages of both directional valves are of automatically resetting design and the second directional valve is designed for alternately assuming an inoperative position and a switching position and the pilot stage of the first directional valve has an external control connection (8; 8') which can be influenced by means of the second directional valve in its switching position and can be vented by means of said second directional valve in its inoperative position, wherein the second directional valve has, as a resetting device for the main stage (14), an air spring (19) which can be influenced and can be vented externally by means of the first directional valve, and a change in state between influencing or venting of the air spring (19) after the first directional valve assumes a switching position takes place only depending on the change in the switching state of the first directional valve, and a change in state between influencing or venting at one working connection (1; 2) after previous influencing or venting which
(Continued)

took place with the second directional valve assuming the switching position takes place only depending on the second directional valve assuming the inoperative position.

12 Claims, 9 Drawing Sheets

(51) Int. Cl.
*F15B 13/04* (2006.01)
*F15B 13/043* (2006.01)

(52) U.S. Cl.
CPC .... *F15B 13/0435* (2013.01); *F15B 2013/041* (2013.01); *F15B 2013/0412* (2013.01); *F15B 2211/30565* (2013.01); *F15B 2211/327* (2013.01); *F15B 2211/329* (2013.01); *F15B 2211/865* (2013.01); *F15B 2211/8757* (2013.01)

(58) Field of Classification Search
CPC ..... F15B 2211/30565; F15B 2211/327; F15B 2211/865; F15B 2211/67; F15B 2211/8855; F15B 2211/8757; F15B 2211/3138; F15B 2211/322; F15B 2211/7053; F15B 2211/8636
See application file for complete search history.

(56) References Cited

U.S. PATENT DOCUMENTS

2018/0073524 A1* 3/2018 Schmidt ..... F15B 11/10
2019/0344885 A1* 11/2019 DeFusco ..... F15B 18/00

* cited by examiner

| Position 7 | Position 13 | 29' | |
|---|---|---|---|
| Off | Off |  | Right-hand pilot stage active |
| Off | On |  | Both pilot stages inactive |
| On | Off |  | Both pilot stages active, state not provided |
| On | On |  | Left-hand pilot stage active |

| Position 7 | Position 13 | 29'' | |
|---|---|---|---|
| Off | Off |  | Right-hand pilot stage active |
| Off | On |  | Both pilot stages inactive |
| On | Off |  | Both pilot stages active, state not provided |
| On | On |  | Left-hand pilot stage active |

VALVE ARRANGEMENT AND CONTROL METHOD

This application is a 35 U.S.C. § 371 National Stage Application of PCT/DE2018/000282, filed on Oct. 3, 2018, which claims the benefit of priority to Serial No. DE 10 2017 009 374.1, filed on Oct. 10, 2017 in Germany, the disclosures of which are incorporated herein by reference in their entirety.

TECHNICAL FIELD

The disclosure relates to a device and to a method for controlling the throughflow of blow-molding fluid during the blow molding of containers.

BACKGROUND

The use of pneumatically pilot-controlled valves in controllers for pneumatic drives is, in certain fields of application, subject to requirements in respect of operational safety, which requirements are specified, for example, in provisions of Directive 2006/42/EG (Machine Directive) or the safety-related standard EN ISO 13849. For example, in door controllers in machine tools, an unexpected movement of the working cylinder has to be reliably prevented during manual intervention by the operator. In accordance with ISO 13849-2:2012, this results in a requirement for the fault exclusion "automatic change in the initial switching position without an input signal" for valves, amongst others.

For the purpose of controlling pneumatic drives, for example a double-acting pneumatic working cylinder, the prior art discloses the use of electropneumatically pilot-controlled valves with an electrically directly operated pilot stage (pilot-control valve, pilot valve) and a main stage (main valve) which is indirectly pneumatically operated by means of the pilot stage. Pneumatically pilot-controlled valves of this kind are also called multistage valves and comprise, for example, an electrically operated 3/2-way pilot-control solenoid valve of seat-type valve construction (also called a "pilot solenoid valve") with mechanical spring resetting as the pilot stage and a 5/2-way spool valve of longitudinal or piston spool construction, which is pneumatically operated likewise against a mechanical spring, as the main stage. The design of electropneumatically pilot-controlled valves of this kind is evident, for example, from the prior art disclosed in documents EP 0 846 873 A2 and EP 0 463 394 B1. Here, the electrically operated 3/2-way pilot-control solenoid valve, as a pilot stage, passes the control air which is applied to its input to the likewise spring-loaded longitudinal or piston spool of the main stage. The control air can be drawn from the pilot-control valve either internally by means of the compressed air connection of the multistage valve (that is to say the compressed air supply, which is switched by the main stage, to the working connections of the drive) or externally via a separate control air connection. External supply of the control air is used, for example, if the main stage is intended to switch only very low pressures which themselves are inadequate for operating the drive piston. When used in safety-related applications, pilot-controlled valves of this kind have the disadvantage that possible fracture of the spring of the pilot-control valve reduces its closing force and the applied air pressure can push against the pilot-control valve and thereby control air can reach the drive spool or piston of the main stage. As a result, the main stage can switch and unexpectedly automatically influence the pneumatic drive.

In order to overcome this disadvantage for safety-related functions, it is generally known in the prior art to employ the option of external supply of the control air for redundant switching. A redundant valve arrangement of this kind known in the prior art comprising the two valves 101 and 102 is illustrated in the circuit diagram of FIG. 10 in its unoperated (unenergized) initial position with the valves 101 and 102 in their inoperative position. The two valves 101 and 102 are designed with mechanical spring resetting in their pilot stage and main stage in each case. The valve 101, which is configured as an electropneumatically pilot-controlled 5/2-way valve, is arranged immediately upstream of the working connections 103 and 104 which it alternately oppositely connects to the compressed air connection 105 and one of the compressed air outputs 106 or 107 (also called exhaust air connections) in an inoperative position and a switching position. The two chambers of a double-acting pneumatic drive which is connected to the working connections 103 and 104 are alternately oppositely influenced and vented by means of the valve 101, that is to say in its two switching states (inoperative position on the one hand and switching position on the other hand). The valve 102, which is configured as an electropneumatically pilot-controlled 3/2-way valve 102 comprising the pilot-control valve 110, is connected upstream of the control air supply of the pilot-control valve 108, which pilot-control valve provides the control air which is required for influencing the main stage 109 of the valve 101. The pilot-control valve 110 draws the control air, which is switched by it, internally by means of the compressed air connection 111. The valve 102 releases the compressed air supply for the pilot-control valve 108 of the valve 101 in its switching state and blocks said compressed air supply in its inoperative state. Therefore, it is always necessary to switch both valves 101 and 102 at the same time in order to be able to cause a change in state at the working connections 103 and 104. A circuit of this kind has the advantage that a spring fracture in one of the two pilot-control valves 108 or 110 without an input signal cannot alone lead to a change in state at the working connections 103 and 104. Therefore, a spring fracture in the pilot-control valve 110 may possibly lead to switching of the main stage 112 of the valve 102, which would lead to a control pressure being provided at the pilot-control valve 108, but since said pilot-control valve does not switch owing to the lack of an electrical control signal, the valve 101 does not change its switching state. Conversely, a spring fracture in the pilot-control valve 108 cannot alone lead to switching of the valve 101 either because no control pressure is applied to the pilot-control valve 108 since the valve 102 does not switch on account of the lack of an electrical control signal. However, one disadvantage of a circuit of this kind is that a spring fracture in only one of the two pilot-control valves 108 or 110 during operation cannot be respectively identified. Therefore, in these two cases, the two valves 101 and 102 would switch when an electrical control signal is applied because the pilot-control valves 108 and 110 are electromagnetically directly switching and each change their position even without an opposing force. Furthermore, in these two cases, the valve 101 would also always switch back again when the control signals are removed because either no control pressure, which counteracts the spring-loaded main stage 109, is applied (=fracture of the spring of the pilot-control valve 108) owing to the valve 102 (with an undamaged return spring) returning to its inoperative position on the pilot-control valve 108 or, in the other case, the undamaged valve 101 returning to its inoperative position in any case (=fracture of the spring of the pilot-control valve 110). Since the valve 101 therefore returns to its inoperative position in both fault situations, the working connections 103 and 104 each also change state again (opposite venting/influencing), and therefore a pneumatic drive which is connected to the working connections 103 and 104 would also change state again. The operation of a double-acting pneumatic drive which is connected to the working connections 103 and 104 would therefore continue in an unaffected manner—inasmuch as is perceivable from the outside—in both fault situations, and therefore individual faults of this kind during operation remain unidentified without additional devices. With the aid of considerations which are routine in the art, this could be achieved, for example, by the integration of appropriate electronic monitoring measures, for example the use of position sensors for checking the switching position of the valves and delayed circuit signals and also appropriate evaluation within a superordinate controller, but this is associated with corresponding expenditure on design and implementation which significantly increases the costs of the actual valve function in practice.

WO 03/004194 A1 discloses a valve arrangement with two automatically resetting main valves which are connected in series and pilot-control valves which are respectively associated with said main valves and can serve, for example, to drive a double-acting pneumatic cylinder. The main valves are arranged in an inoperative position and a switching position for the purpose of alternately oppositely influencing and venting the two chambers of the working cylinder, wherein in each case both main valves have to switch to assume the switching position. For the purpose of implementing a safety function, the main valves are each designed for operating switches which allow electrical operation of the electrically operated pilot-control valves by means of external relays. Electrical operation takes place only when both main valves are in their inoperative position and the switches are closed. If, when the main valves are reset, a fault occurs by way of one of the main valves not being returned, the electrical circuit remains interrupted, as a result of which renewed operation is not possible. This requires the integration of an appropriate electrical circuit with switches and relays, and this generates corresponding expenditure on design and costs.

DE 10 2007 041 583 A1 discloses a valve arrangement comprising a first main valve, which is driven by a first pilot-control valve, and a second main valve, which is driven by means of a second pilot-control valve, which first main valve and second main valve are interconnected in such a way that, when the two main valves are driven at the same time by means of the pilot-control valves, a switching process from a default position to a working position takes place, as a result of which two working connections are respectively alternately oppositely influenced and vented in the default position and in the working position. In order to realize a safety function for preventing a change in load at the working connections when only one of the two main valves is driven, a pneumatic circuit comprising two change-over valves, in each case arranged upstream of the pilot-control valves and having three connections in each case, is provided, said pneumatic circuit being relatively complex and requiring comparatively complicated pneumatic duct guidance and interconnection together with a correspondingly large installation space.

DE 10 2009 037 120 A1 discloses a pneumatic safety valve device comprising two bistable main valves which can each be operated by a pilot-control valve in order to be able to be switched over to a working position in which they have the effect that a pneumatic pressure is applied to two working connections. The structural design of the safety valve device causes the main valves to switch over to the working position only when the two pilot-control valves are operated substantially synchronously. If, in the event of only asynchronous operation, only one of the main valves is switched over to the working position, this fault state continues to be stored until resetting is performed by means of a separate resetting valve device. The pneumatic interconnection of the safety valve device is, on account of its intended purpose for providing pneumatic fault storage, relatively complex and requires comparatively complicated pneumatic duct guidance and interconnection together with a correspondingly large installation space.

SUMMARY

The disclosure is based on the object of avoiding the disadvantages outlined. In particular, the intention is to create a structurally simple valve arrangement for reliably controlling pneumatic drives which provides protection against a sudden automatic change in the initial switching position without an input signal in the event of a fault in a resetting device of a pilot stage and, for this situation, enables effective fault identification by purely pneumatic means.

According to the disclosure, the object is achieved by a valve arrangement as claimed in claim 1, advantageous embodiments being described in the dependent claims.

The core of the disclosure is formed by a valve arrangement, comprising a first and a second working connection, which can be connected to a pneumatic drive, and a first and a second, in each case electropneumatically pilot-controlled directional valve, in which valve arrangement one or both directional valves is or are arranged upstream of the working connections for the purpose of influencing and venting said working connections, wherein the pilot stages of both directional valves are of automatically resetting design and the second directional valve is designed for alternately assuming an inoperative position and a switching position and the pilot stage of the first directional valve has an external control connection which can be influenced by means of the second directional valve in its switching position and can be vented by means of said second directional valve in its inoperative position, wherein the second directional valve has, as a resetting device for the main stage, an air spring which can be influenced and can be vented externally by means of the first directional valve, and a change in state between influencing or venting of the air spring of the second directional valve after the first directional valve assumes a switching position takes place only depending on the change in the switching state of the first directional valve, and a change in state between influencing or venting at one of the two working connections after previous influencing or venting which took place with the second directional valve assuming the switching position takes place only depending on the second directional valve assuming the inoperative position. The valve arrangement provides a structurally simple controller for a double-acting pneumatic drive, which controller provides effective protection against a sudden automatic change in the initial switching position without an input signal in the event of a fault in a resetting device of a pilot stage and which, for this situation, also at the same time renders possible effective fault identification by purely pneumatic means. During operation, the valve arrangement causes alternating influencing and venting of the working connections and therefore control of a double-acting pneumatic drive, which is connected to the working connections, in both of its directions of movement. On account of the redundant arrangement of the two directional valves, initially the fundamental fault exclusion that a fault in the resetting device of one the two pilot stages (for example a spring fracture in a pilot-control valve) does not lead to an unintended change in state at the working connections is ensured. It is always necessary to switch both directional valves in order to be able to cause a change in state (opposite venting/influencing) at the working connections. A fault in the pilot stage of the second directional valve in the unoperated (unenergized) inoperative position can lead to switching of its main stage, which would lead to a control pressure being provided at the control connection of the first directional valve, but since said first directional valve does not switch owing to the lack of an electrical control signal, the first directional valve does not change its switching state. Conversely, a fault in the pilot stage of the first directional control valve in the unoperated inoperative position also cannot lead to switching of its main stage because no control pressure is applied to its pilot stage since the second directional valve does not switch without an electrical control signal. However, furthermore, the valve arrangement has the further advantage that a fault in one of the two pilot stages of the two directional valves during operation is reliably identified from the outside. For example, the two directional valves initially switch normally when electrical control signals are applied in the event of a fault in the resetting device in one of the two pilot-control valves because the pilot stages which are operated electrically (for example by switching magnets) each also change their position even without an opposing force of an automatic resetting device (for example a mechanical spring). However, in these fault situations, a pneumatic drive which is connected to the drive connections would not return again when the electrical control signals are removed once again. This is because, on account of the crosswise interconnection, both directional valves must leave their previously assumed switching state again (switch back) so that a renewed change in state (reversed opposite influencing/venting of the working connections) can occur at a connected pneumatic drive. If only the first directional valve changes its switching position when the electrical input signal is removed (=fault in the resetting device of the pilot stage of the second directional valve), no renewed change in state occurs at the connected cylinder because no renewed change in state between influencing or venting takes place at a working connection which took place and was influenced or vented previously with the second directional valve assuming the switching position. In this case, the main stage of the second directional valve cannot return to its inoperative position when the first directional valve influences the air spring either because, on account of the defective pilot-control valve which cannot switch back, a control pressure which counteracts the return movement of the main stage continues to be applied (which control pressure is not externally controlled in contrast to the manner of operation of the first directional valve). Consequently, the state of a chamber of the pneumatic drive, which chamber is connected to the drive connection in question, also cannot change from influencing to venting, or vice versa; the movement of the pneumatic drive is blocked. The pneumatic drive cannot reverse; the fault is identified. In the converse case (=fault in the resetting device of the pilot stage of the first directional valve), neither the first nor the second directional valve return to their inoperative position because they block each other. The main stage of the first directional valve cannot switch back as long as the second directional valve has not switched back because a control pressure, which counteracts the return movement of its main stage, is still applied by means of the control connection and the defective pilot stage of the first directional valve. In turn, the main stage of the second directional valve cannot switch back as long as the main stage of the first directional valve has not switched back because the air spring which is influenced externally by means of the first directional valve in its inoperative position does not build up any pressure. Since there is no renewed change in state at the working connections and therefore no renewed change in state (reversed opposite influencing/venting) occurs at a connected pneumatic drive either, a pneumatic drive which is connected to the working connections cannot reverse and the fault is identified. Therefore, a pneumatic drive which is connected to the working connections cannot change its state in either of the fault situations. Consequently, both fault situations can be identified from the outside on the basis of the unchanged position of the drive after switching.

In a structurally simple refinement with commercial and cost effectively available pneumatic components, the main stages of the two directional valves are configured with a spool construction and/or the pilot stages of the two directional valves are configured with a seat-type construction.

Proceeding from the basic configuration of the valve arrangement, different valve functions are realized in different detailed embodiments:

In a structurally simple embodiment for alternately oppositely influencing and venting the chambers of a double-acting pneumatic drive (for example of a double-acting cylinder), the first directional valve is designed for alternately assuming an inoperative position and a switching position with an automatically resetting main stage, wherein the second directional valve connects the external control connection of the first directional valve, in its switching position, to a compressed air source via a control line and, in its inoperative position, to a compressed air output and its air spring is influenced by means of the first directional valve in its inoperative position and is vented by means of said first directional valve in its switching position, and wherein the first directional valve is arranged upstream of the two working connections and, in the switching position, connects the first working connection to a compressed air source and connects the second working connection to a compressed air output and, in the inoperative position, connects the second working connection to a compressed air source and connects the first working connection to the control line via a connecting line, wherein a check valve which provides blocking in the opposite direction is arranged in the connecting line and/or a throttle device is or are arranged upstream of the compressed air connection of the second directional valve. This embodiment of the valve arrangement provides a structurally simple controller for a double-acting pneumatic drive, which controller provides effective protection against a sudden automatic change in the initial switching position without an input signal in the event of a fault in a resetting device of a pilot stage and, for this situation, also renders possible effective fault identification by purely pneumatic means. During operation, the valve arrangement causes, in the parallel inoperative positions and switching positions of the two directional valves, alternating opposite influencing and venting of the working connections and therefore control of a double-acting pneumatic drive, which is connected to the working connections, in both of its directions of movement. On account of the redundant arrangement of the two directional valves, initially the fundamental fault exclusion that a fault in the resetting device of one the two pilot stages (for example a spring fracture in a pilot-control valve) does not lead to an unintended change in state at the working connections is ensured. It is always necessary to switch both directional valves together in order to be able to cause a change in state (opposite influencing/venting) at the working connections. A fault in the resetting device of the pilot stage of the second directional valve in its unoperated (unenergized) inoperative position can lead to switching of its main stage, which would lead to a control pressure being provided at the control connection of the first directional valve, but since said first directional valve does not switch owing to the lack of an electrical control signal, the first directional valve does not change its switching state. At the same time, in this fault situation, the check valve or the throttle device prevent or delay influencing of the first working connection via the control line, the connecting line and the first directional valve, which is in the inoperative position, either entirely or in any case in such a way that this cannot lead to a dangerous—sudden—movement of a pneumatic drive which is connected to the working connection. If the valve arrangement is designed only with a throttle device which is arranged upstream of the compressed air connection of the second directional valve, instead of with a check valve, a change in state (influencing) of the first working connection is not completely suppressed in each case in the event of a fault in the resetting device of the pilot stage of the second directional valve in the unoperated inoperative position—depending on the condition of a pneumatic drive which is connected to the working connections. However, since the second working connection is influenced by means of the first directional valve and the compressed air source at the same time in this fault situation, there is, in principle, a counterpressure which counteracts the unintended change in position of a pneumatic drive which is connected to the working connections. However, in the event of any force differences which are produced depending on the condition of a pneumatic drive which is connected to the working connections, it is ensured, on account of the throttle device, that a change in position can occur at most at a considerably reduced speed, which generally satisfies existing practical stipulations for operational safety and at the same time likewise ensures the ability to identify the fault. Conversely, a fault in the resetting device of the pilot stage of the first directional valve in the unoperated (unenergized) inoperative position also cannot lead to switching of its main stage because no control pressure is applied to its pilot stage since the second directional valve does not switch without an electrical control signal. However, furthermore, the valve arrangement has the further advantage that a fault in the resetting device of one of the two pilot stages (for example a spring fracture in one pilot-control valve) of the two directional valves during operation is reliably identified. In both of these cases, the two directional valves initially switch normally when electrical control signals are applied because the electrically operated pilot stages each also change their position without an opposing force of the resetting devices (for example mechanical springs). The first directional valve connects, in the switching position, the first working connection to the compressed air source and the second working connection to a compressed air output; a pneumatic drive which is connected to the working connections changes its position. However, in these fault situations, a pneumatic drive which is connected to the drive connections would not reverse again when the electrical control signals are removed once again. This is because, on account of the crosswise interconnection, both directional valves always have to switch back so that a renewed change in state (reversed opposite influencing/venting of the working connections) can occur at the connected cylinder. If only the first directional valve returns the inoperative position without an electrical input signal (=fault in the resetting device of the pilot stage of the second directional valve), no renewed change in state occurs at the connected cylinder because either the check valve (if present) or the first working connection (if only a throttle device is present) is still influenced by means of the second directional valve and the first working connection and the associated chamber of the pneumatic drive are not vented. In this fault situation, the main stage of the second directional valve cannot return to its inoperative position in spite of influencing of the air spring because a control pressure which counteracts the return movement of the main stage of said second directional valve is still applied by means of the defective pilot stage (which control pressure is not externally controlled in contrast to the manner of operation of the first directional valve). If the valve arrangement is designed only with a throttle device which is arranged upstream of the compressed air connection of the second directional valve, instead of with a check valve, likewise no renewed change in state occurs at the connected cylinder because the first working connection and the associated chamber of the pneumatic drive are still influenced by means of the second directional valve and are not vented. There is, in principle, a counterpressure which counteracts the change in position of a pneumatic drive which is connected to the working connections. In this fault situation, a movement of a pneumatic drive which is connected to the working connections is not completely suppressed in every case—depending on the condition of the pneumatic drive. However, in the event of any force differences which are produced depending on the condition of a pneumatic drive which is connected to the working connections, it is ensured, on account of the throttle device, that a change in position can occur at most at a considerably reduced speed, which generally satisfies existing practical stipulations for operational safety and at the same time likewise ensures the ability to identify a fault. In the converse case (=fault in the resetting device of the pilot stage of the first directional valve), neither the first nor the second directional valve return to their inoperative position because they block each other. The main stage of the first directional valve cannot switch back as long as the second directional valve has not switched back because a control pressure, which counteracts the return movement of its main stage, is still applied by means of the external control connection. In turn, the main stage of the second directional valve cannot switch back as long as the main stage of the first directional valve has not switched back because the air spring which is influenced externally by means of the first directional valve only in its inoperative position does not build up any pressure. Since no renewed change in state occurs at the working connections, a pneumatic drive which is connected to the working connections cannot reverse and the fault is identified.

In a structurally simple refinement of the above embodiments, the second directional valve is configured as a 3/2-way valve and is designed, as a resetting device for the main stage, with an air spring which can be influenced and can be vented externally by means of the first directional valve.

In a structurally simple refinement of the above embodiments, the second directional valve is configured as a 4/2-way valve and is designed, as a resetting device for the main stage, with an air spring which can be influenced and can be vented externally by means of the first directional valve.

In an alternative embodiment for alternately oppositely influencing and venting the chambers of a double-acting pneumatic drive (for example a double-acting cylinder) with modified duct guidance, the first directional valve is designed for alternately assuming an inoperative position and a switching position with an automatically resetting main stage, wherein the second directional valve connects the external control connection of the first directional valve, in its switching position, to a compressed air source via a control line and, in an inoperative position, to a compressed air output and its air spring is influenced by means of the first directional valve in its inoperative position and is vented by means of said first directional valve in its switching position, and wherein the first directional valve is arranged upstream of the first working connection and, in the switching position, connects said first working connection to a compressed air source and, in the inoperative position, connects said first working connection to a compressed air output, and wherein the second directional valve is arranged upstream of the second working connection and, in the inoperative position, connects said second working connection to a compressed air source and, in the switching position, connects said second working connection to a compressed air output. In this embodiment, it is possible to dispense with the arrangement of a check valve or a throttle device which is arranged upstream of the compressed air connection of the second directional valve, while maintaining the desired safety features, on account of the modified duct guidance. Owing to the redundant arrangement, both the pilot stage of the first directional valve, which pilot stage is designed with the external control connection, and also the pilot stage of the second directional valve have to switch in order to be able to cause a change in state (opposite venting/influencing) at the two working connections. In the event of a fault in the resetting device of the pilot stage of the second directional valve, no change in state (opposite venting/influencing) occurs at the two working connections because the pilot stage of the first directional valve does not switch without an electrical control signal. The fault in the resetting device of the pilot stage of the second directional valve can lead to switching of its main stage, but this only leads to additional venting of the second working connection as well. In this case, the first working connection continues to be vented by means of the first directional valve which remains in its inoperative position. A pneumatic drive which is connected to the two working connections stays in its position. No change in state (opposite venting/influencing) occurs at the two working connections in the event of a fault in the resetting device of the pilot stage of the first directional valve either because no control pressure is applied to its pilot stage since the second directional valve does not switch without an electrical control signal. The first working connection continues to be vented by means of the first directional valve; the second working connection is influenced by means of the second directional valve. A pneumatic drive which is connected to the two working connections stays in its position. In this embodiment, the valve arrangement furthermore also has the further advantage that a fault in the resetting device of one the two pilot stages of the two directional valves is reliably identified during operation in each case. In these fault situations, a pneumatic drive which is connected to the working connections would not reverse again when the electrical control signals are removed. This is because, on account of the crosswise interconnection, both directional valves always have to switch back so that a renewed change in state (reversed opposite influencing/venting of the working connections) can occur at the connected cylinder. If only the first directional valve returns the inoperative position, after previously assuming the switching position, without an electrical input signal (=fault in the resetting device of the pilot stage of the second directional valve), no renewed change in state occurs at the connected cylinder because the second working connection is still vented by means of the second directional valve. In this case, the first working connection is also vented by means of the first directional valve which is returned to its inoperative position. A pneumatic drive which is connected to the two working connections stays in the position it last assumed. In the converse case (=fault in the resetting device of the pilot stage of the first directional valve), neither the first nor the second directional valve return to their inoperative position because they block each other. The main stage of the first directional valve cannot switch back as long as the second directional valve has not switched back because a control pressure, which counteracts the return movement of its main stage, is still applied by means of the external control connection. In turn, the main stage of the second directional valve cannot switch back as long as the main stage of the first directional valve has not switched back because the air spring which is influenced externally by means of the first directional valve only in its inoperative position does not build up any pressure. The first working connection continues to be influenced by means of the first directional valve and the second working connection continues to be vented by means of the second directional valve. Since no renewed change in state (opposite venting/influencing) occurs at the working connections, a pneumatic drive which is connected to the working connections cannot reverse and the fault is identified.

In a structurally simple refinement of the above embodiments, the first directional valve is configured as a 5/2-way valve.

In an alternative embodiment for rendering possible both-way venting of the two working connections, the first directional valve is configured as a both-way electropneumatically pilot-controlled 5/3-way valve with a both-way automatically resetting main stage and is designed for assuming a vented central position, as the inoperative position, and also a first and a second switching position, wherein the first switching position is assumed in the event of operation and influencing of the pilot stage which is designed with the external control connection, and wherein the second directional valve connects the external control connection of the first directional valve, in its switching position, to a compressed air source via a control line and, in an inoperative position, to a compressed air output and its air spring is influenced by means of the first directional valve in its second switching position and is vented by means of said first directional valve in its first switching position and inoperative position, and wherein the first directional valve is arranged upstream of the first working connection and, in the first switching position, connects said first working connection to a compressed air source and, in the second switching position and the inoperative position, connects said first working connection to a compressed air output, and wherein the second directional valve is arranged upstream of the second working connection and, in the inoperative position, connects said second working connection to a compressed air source and, in the switching position, connects said second working connection to a compressed air output. In this embodiment, it is possible to dispense with the arrangement of a check valve or a throttle device which is arranged upstream of the compressed air connection of the second directional valve, while maintaining the desired safety features, on account of the modified duct guidance. Owing to the redundant arrangement, both the pilot stage of the first directional valve, which pilot stage is designed with the external control connection, and also the pilot stage of the second directional valve have to switch in order to be able to cause a change in state (opposite venting/influencing) at the two working connections. In the event of a fault in the resetting device of the pilot stage of the second directional valve, no change in state (opposite venting/influencing) occurs at the two working connections because the pilot stage of the first directional valve does not switch without an electrical control signal. The fault in the resetting device of the pilot stage of the second directional valve can lead to switching of its main stage, but this only leads to additional venting of the second working connection as well. In this case, the first working connection continues to be vented by means of the first directional valve which remains in its inoperative position. A pneumatic drive which is connected to the two working connections stays in its position. No change in state (opposite venting/influencing) occurs in the initial position at the two working connections in the event of a fault in the resetting device of the pilot stage of the first directional valve either because no control pressure is applied to its pilot stage since the second directional valve does not switch without an electrical control signal. The first working connection continues to be vented by means of the first directional valve; the second working connection is influenced by means of the second directional valve. A pneumatic drive which is connected to the two working connections stays in its position. In this embodiment, the valve arrangement furthermore also has the further advantage that a fault in the resetting device of one of the two pilot stages of the two directional valves is reliably identified during operation. In these fault situations, a pneumatic drive which is connected to the working connections would not reverse again when the electrical control signals are removed. This is because, on account of the crosswise interconnection, both directional valves always also have to change their previously assumed switching state again so that a renewed change in state (reversed opposite influencing/venting of the working connections) can take place at a connected pneumatic drive and the drive can reverse again. The renewed reversed opposite influencing/venting of the working connections after opposite influencing and venting which took place previously with the first directional valve assuming the first switching position and the second directional valve assuming the switching position takes place only with the first directional valve assuming the second switching state together with the second directional valve switching back.

In a structurally simple refinement of the above embodiments, the second directional valve is configured as a 5/2-way valve and is designed, as a resetting device for the main stage, with an air spring which can be influenced and can be vented externally by means of the first directional valve, provided that no refinement as a 3/2-way valve or 4/2-way valve is provided.

In order to increase the vibrational and operational stability, the resetting device of the main stage of the first directional valve is designed parallel with a mechanical spring and an air spring, wherein the air spring is influenced externally by means of the second directional valve in its inoperative position and is vented in its switching position, provided that the first directional valve is designed as a directional valve for assuming two switching states (an inoperative position and a switching position). Here, the second directional valve is configured as a 5/2-way valve.

An additional valve function is achieved by a particular control method, in which the pilot stages of the two directional valves can be both jointly and also individually electrically switched, provided that, in one of the above embodiments of the valve arrangement, the first directional valve is designed for alternately assuming an inoperative position and a switching position with an automatically resetting main stage and is configured as a 5/2-way valve, and is arranged upstream of the two working connections and, in the switching position, connects the first working connection to a compressed air source and connects the second working connection to a compressed air output and, in the inoperative position, connects the second working connection to a compressed air source and connects the first working connection to the control line via a connecting line, wherein a throttle device is arranged upstream of the compressed air connection of the second directional valve and there is no check valve arranged in the connecting line. As a result, with respect to the working connections, the valve arrangement can be controlled overall as a 5/3-way valve with an open central position (both working connections influenced). Here, the control position, which corresponds to a 5/3-way valve in its open central position, corresponds to the switching position only of the second directional valve (while the first directional valve is in the inoperative position).

An additional valve function is achieved by a particular control method, in which the pilot stages of the two directional valves can be both jointly and also individually electrically switched, provided that, in one of the above embodiments of the valve arrangement, the first directional valve is designed for alternately assuming an inoperative position and a switching position with an automatically resetting main stage and is configured as a 5/2-way valve, and is arranged upstream of the first working connection and, in the switching position, connects said first working connection to a compressed air source and, in the inoperative position, connects said first working connection to a compressed air output, while the second directional valve is arranged upstream of the second working connection and, in the inoperative position, connects said second working connection to a compressed air source and, in the switching position, connects said second working connection to a compressed air output. As a result, with respect to the working connections, the valve arrangement can be controlled overall as a 5/3-way valve with a vented central position (both working connections vented). Here, the control position, which corresponds to a 5/3-way valve in its vented central position, corresponds to the switching position only of the second directional valve (while the first directional valve is in the inoperative position).

BRIEF DESCRIPTION OF THE DRAWINGS

Further advantages of the disclosure are evident below from the description of preferred exemplary embodiments of the disclosure with reference to FIGS. 1 to 10, in which.

DETAILED DESCRIPTION

Figure 1:
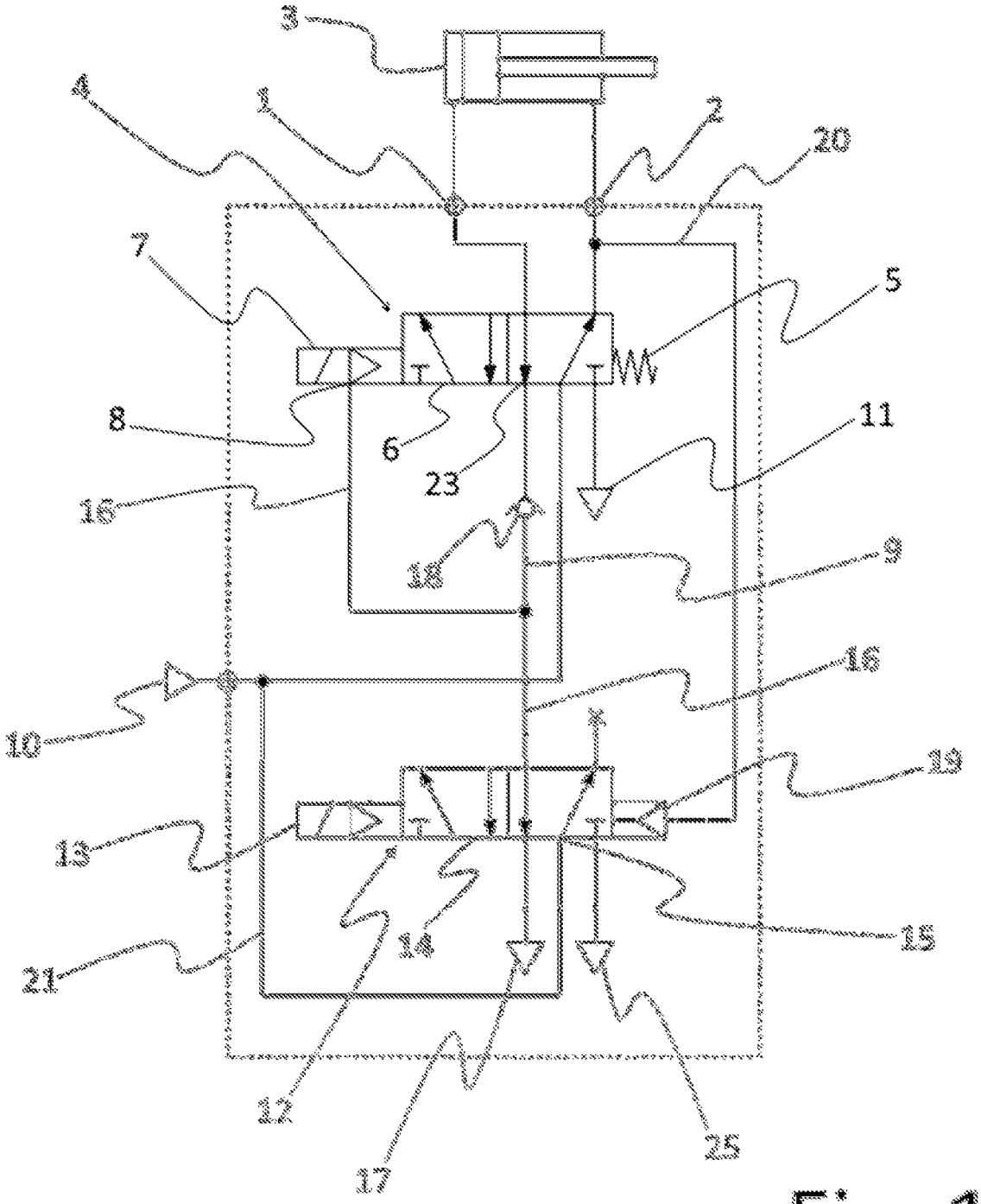
FIG. 1 shows a schematic circuit diagram of a valve arrangement according to the disclosure in line with a first exemplary embodiment.

FIG. 1 shows an exemplary embodiment of a valve arrangement according to the disclosure in the unoperated (unenergized) initial position with all of the valves in their inoperative position. According to FIG. 1, the valve arrangement comprises a first working connection 1 and a second working connection 2 which are connected to a pneumatic drive which is designed as a double-acting pneumatic working cylinder 3. Furthermore, the valve arrangement comprises a first electropneumatically pilot-controlled directional valve which is designed as a pilot-controlled 5/2-way valve 4 and has, as a resetting device, a mechanical spring 5 which automatically switches the main stage 6 of the 5/2-way valve 4, which is spring-loaded by said mechanical spring, back to an inoperative position in the unenergized state. As a pilot-control device, the 5/2-way valve 4 is designed with an electromagnetically operated, automatically resetting pilot-control valve 7 which switches the main stage 6 of the 5/2-way valve 4 from the inoperative position to a switching position when it is operated and a control pressure is applied to the control connection 8. The 5/2-way valve 4 is arranged upstream of the two working connections 1 and 2 and, in the inoperative position, connects the working connection 1 to the connecting line 9 and connects the working connection 2 to the compressed air source 10. In the switching position, the 5/2-way valve 4 connects the working connection 1 to the compressed air source 10 and connects the working connection 2 to the compressed air output 11. A second electropneumatically pilot-controlled directional valve, which is likewise designed as a pilot-controlled 5/2-way valve 12, is arranged upstream of the control connection 8. As a pilot-control device, the 5/2-way directional valve 12 is likewise designed with an electromagnetically operated, automatically resetting pilot-control valve 13 which switches the main stage 14 of the 5/2-way valve 12 from the inoperative position to a switching position when it is operated and a control pressure is applied, wherein the pilot-control valve 13 draws the required control pressure for operating the actuating element of the main stage 14 internally by means of the compressed air connection 15. The 5/2-way valve 12 connects the control line 16 and the control connection 8 to the compressed air source 10 in the switching position and to the compressed air output 17 in the inoperative position, wherein the check valve 18, which is arranged in the connecting line 9, provides blocking when the control line 16 is influenced by the 5/2-way valve 12. At the same time, in the inoperative position, the left-hand chamber of the pneumatic drive is connected to the compressed air output 17 by means of the 5/2-way valve 4, the connecting line 9 and the 5/2-way valve 12 and is therefore vented since the check valve 18 provides blocking only in the opposite direction. As a resetting device, the 5/2-way valve 12 has an air spring 19 which switches the main stage 14 of the 5/2-way valve 12, which main stage is spring-loaded by it, back to an inoperative position in the unenergized state when a control pressure is applied to the air spring 19. To this end, the air spring 19 is influenced externally by means of the 5/2-way valve 4 in its inoperative position via the feed line 20 which is arranged in parallel to the working connection 2. The valve arrangement initially ensures, on account of the redundant arrangement of the two 5/2-way valves 4 and 12, the fundamental fault exclusion that a fault in the resetting device of one the two pilot-control valves 7 or 13 (for example a spring fracture) does not lead to an unintended movement of a pneumatic drive which is connected to the working connections 1 and 2. Both 5/2-way valves 4 and 12 always have to be jointly switched in order to be able to cause a change in state (opposite of the influencing/venting) at the working connections 1 and 2. A spring fracture in the pilot-control valve 13 in the unenergized inoperative position can lead to switching of the main stage 14 of the 5/2-way valve 12, which would lead to a control pressure being provided at the pilot-control valve 7, but since said pilot-control valve does not switch owing to the lack of an electrical control signal, the 5/2-way valve 4 does not change its switching state. At the same time, in this fault situation, the check valve 18 prevents influencing of the left-hand chamber of the pneumatic working cylinder 3 via the control line 16 and the 5/2-way valve 4 which is in the inoperative position. Conversely, a spring fracture in the pilot-control valve 7 cannot lead to switching of the 5/2-way valve 4 either because no control pressure is applied to the pilot-control valve 7 since the 5/2-way valve 12 does not switch on account of the lack of an electrical control signal. However, the valve arrangement furthermore has the further advantage that a fault, such as a spring fracture for example, in one of the two pilot-control valves 7 or 13 during operation can be reliably identified. In both of these cases, the two 5/2-way valves 4 and 12 initially switch normally when electrical control signals are applied because the electromagnetically controlled pilot-control valves 7 and 13 also change their position without an opposing force by a mechanical spring. The 5/2-way valve 4 connects, in the switching position, the working connection 1 to the compressed air source 10 and the working connection 2 to the compressed air output 11; the pneumatic working cylinder 3 is extended. However, in the event of a spring fracture in one of the two pilot-control valves 7 or 13, the pneumatic working cylinder 3 is not retracted again when the control signals are removed. This is because, on account of the crosswise interconnection of the two 5/2-way valves 4 and 12, both pilot-control valves 7 and 13 always have to switch back so that a renewed change in state (opposite venting/influencing) can occur at the working connections 1 and 2. If only the 5/2-way valve 4 switches back (=spring fracture in the pilot-control valve 13), the pneumatic working cylinder 3 cannot be retracted because the check valve 18 is still influenced by means of the 5/2-way valve 12 and the control line 16, and the left-hand chamber of the pneumatic working cylinder 3 is not vented. The main stage 14 of the 5/2-way valve 12 cannot switch back in spite of influencing of the air spring 19 because a control pressure which counteracts the main stage 14 is still applied by means of the defective pilot-control valve 13, which draws the control pressure internally by means of the compressed air connection 15. In the converse case (=spring fracture in the pilot-control valve 7), neither the 5/2-way valve 4 nor the 5/2-way valve 12 switch because they block each other. The main stage 6 of the 5/2-way valve 4 cannot switch back as long as the 5/2-way valve 12 has not switched back because a control pressure, which counteracts the spring-loaded main stage 6, is still applied by means of the defective pilot-control valve 7. In turn, the main stage 14 of the 5/2-way valve 12 cannot switch back as long as the main stage 6 of the 5/2-way valve 4 has not switched back because the air spring 19 does not build up any pressure. Since no renewed change in state occurs at the working connections 1 and 2, the working cylinder 3 remains extended and the fault is identified.

Figure 2:
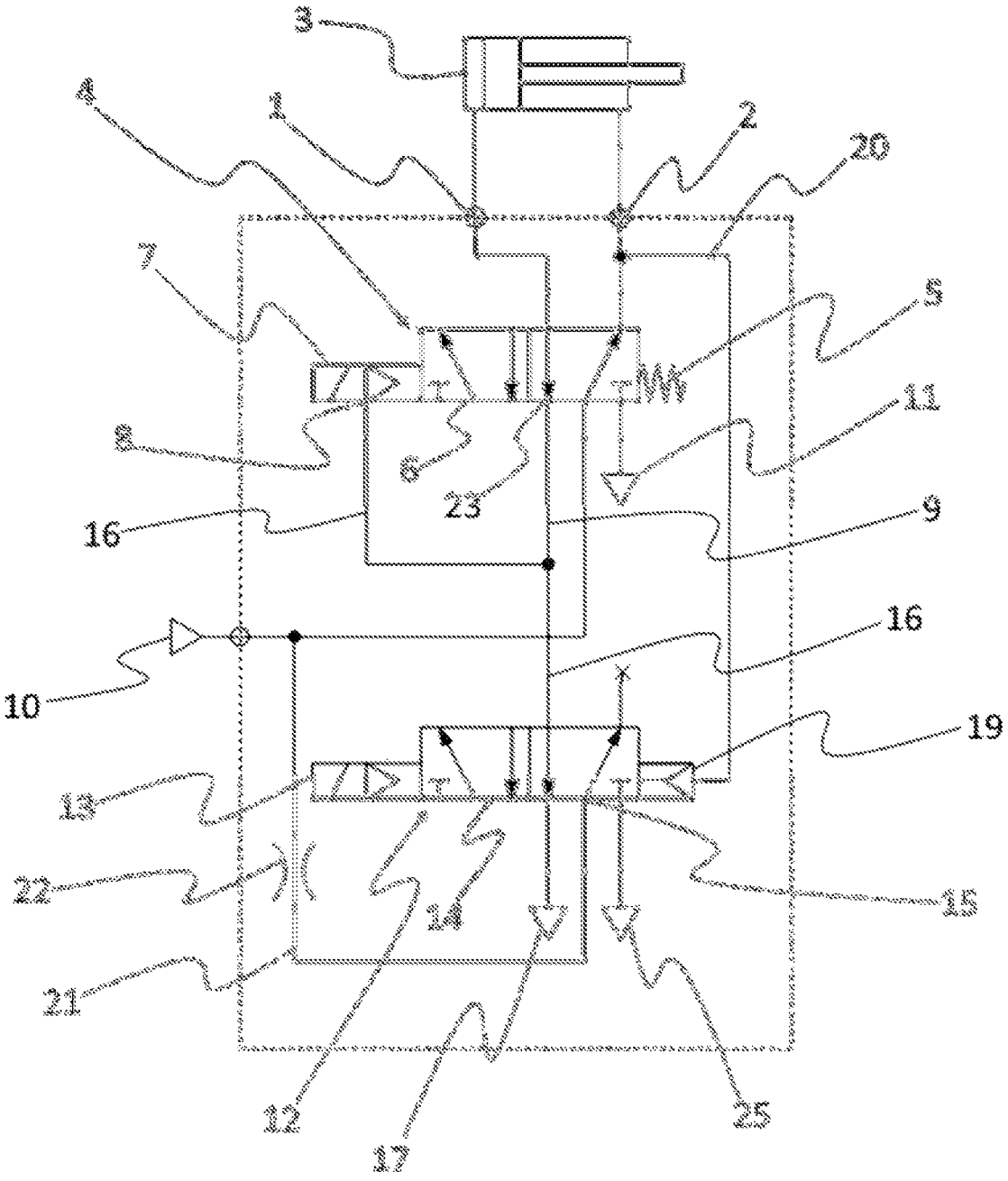
FIG. 2 shows a schematic circuit diagram of a valve arrangement according to the disclosure in line with a second exemplary embodiment.

FIG. 2 shows an alternative exemplary embodiment of the valve arrangement according to the disclosure in the unoperated (unenergized) initial position with all of the valves in their inoperative position. In the valve arrangement, which is identical to the valve arrangement according to FIG. 1, there is no check valve arranged in the connecting line 9, in contrast to the valve arrangement according to FIG. 1. Instead of a check valve, a throttle device, which is designed as a constant cross-sectional constriction 22 in the supply line 21 to the compressed air connection 15 of the 5/2-way valve 12, is arranged upstream of the compressed air connection 15 in the valve arrangement according to FIG. 2. Furthermore, the throttle device can also be designed as a variable cross-sectional constriction, for example as a throttle valve, instead of as a constant cross-sectional constriction 22. The design as a constant cross-sectional constriction 22 provides a high degree of fail safety since it does not contain any moving parts, but rather is merely a constriction of the respective line cross section, which constriction can be made either when forming the line or embodied as a subsequently inserted panel which constricts the cross section. If the valve arrangement is designed as a modular structural unit with a common base plate for the lines (air ducts and electrical conductors) and connections and valve modules or valve bodies which are mounted on the base plate, as is evident from the prior art disclosed by EP 0 463 394 B1 or DE 39 27 637 C1 for example, the cross-sectional constriction 22 can further be embodied, in a structurally simple manner, as a section with a smaller diameter in the course of the corresponding duct bore or duct opening in the base plate. In the switching position, the 5/2-way valve 12 influences—as in the valve arrangement according to FIG. 1 as well—the control connection 8 of the 5/2-way valve 12 by way of connecting the control line 16 to the compressed air source 10. In this embodiment of the valve arrangement (according to FIG. 2), a spring fracture in the pilot-control valve 13 in the unenergized inoperative position can also lead to switching of the main stage 14 of the 5/2-way valve 12, which would result in a control pressure being provided at the pilot-control valve 7. However, since said pilot-control valve does not switch owing to the lack of an electrical control signal, the 5/2-way valve 4 does not change its switching state. However, since there is no check valve arranged in the connecting line 9 in the embodiment according to FIG. 2, this at the same time leads, in the unenergized inoperative position, to influencing of the valve connection 23 of the 5/2-way valve 4 (which does not switch) and as a result to influencing of the left-hand chamber of the working cylinder 3 via the control line 16 and the connecting line 9. The same situation would exist in the valve arrangement according to FIG. 1 in the event of a simultaneous spring fracture in the pilot-control valve 13 and a fault in (failure of) the check valve 18. Since the right-hand chamber of the pneumatic drive 3 is influenced by the compressed air source 10 by means of the 5/2-way valve 4 at the same time in this state, there is, in principle, a mating pressure, which counteracts the unintended extension of the pneumatic drive 3, in this fault situation. If a piston rod-free pneumatic drive is controlled by the valve arrangement, the pressure in said drive is equalized in the event of the simultaneously influencing of both chambers and said drive does not move. However, if—in accordance with the exemplary embodiments according to FIGS. 1 and 2—a piston rod cylinder (with a piston rod which is formed on one side of the piston) is driven by the valve arrangement, different force moments take effect on account of different influencing surfaces on either side of the piston given the same pressure in each case since said force moments are respectively determined and defined by the pressure acting on the surface in question (p=F/A). The piston surface which is taken up by the piston rod creates a force difference. In practice, this force difference can be approximately 10% of the maximum force of the cylinder in the case of ISO-standard cylinders, depending on the diameter of the piston rod:

| ISO-standard cylinder at 5 bar operating pressure aerated on either side, without friction | |
|---|---|
| D [mm] | Difference force [N] |
| Ø32 | 57 |
| Ø40 | 101 |
| Ø50 | 157 |
| Ø63 | 157 |
| Ø80 | 245 |
| Ø100 | 245 |
| Ø125 | 402 |

Since the cross-sectional constriction 22 is arranged upstream of the compressed air connection 15 of the 5/2-way valve 12, it is ensured in a fault situation of this kind that the piston rod is extended not only with a reduced force (in comparison with normal operation) (in accordance with the applied force difference), but rather additionally also at a reduced speed. If the extension of the operating cylinder 3 is not completely suppressed in this fault situation either, the execution of a dangerous—sudden—movement is prevented however, this generally satisfying the existing practical stipulations in this respect for operational safety of pneumatic drives of this kind.

Figure 3:
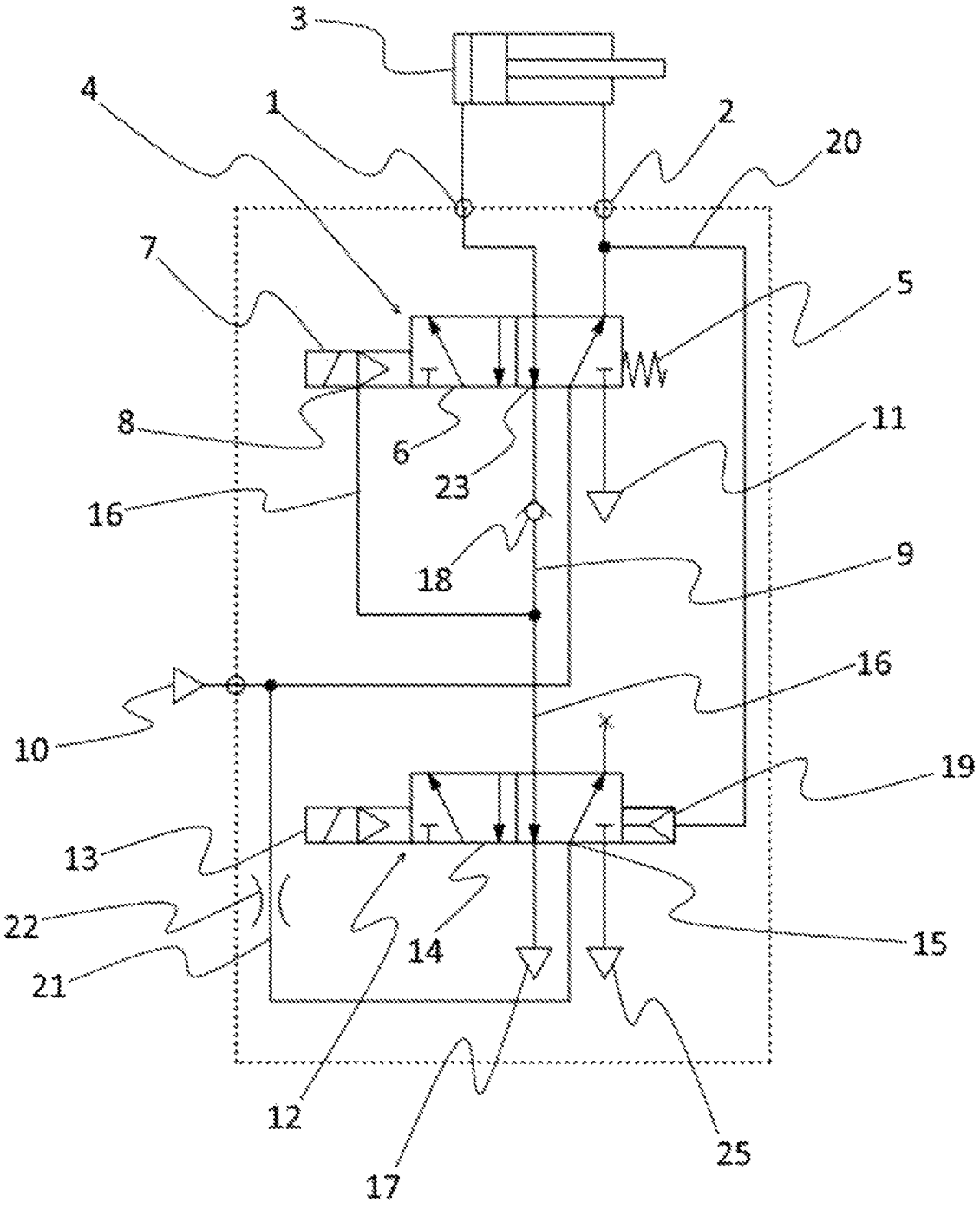
FIG. 3 shows a schematic circuit diagram of a valve arrangement according to the disclosure in line with a third exemplary embodiment.

FIG. 3 shows an alternative exemplary embodiment of the valve arrangement according to the disclosure in the unoperated (unenergized) initial position with all of the valves in their inoperative position. In the valve arrangement which is otherwise identical to the valve arrangement according to FIG. 1, a throttle device, which is designed as a constant cross-sectional constriction 22 which is arranged in the supply line 21 to the compressed air connection 15 of the 5/2-way valve 12, is additionally arranged upstream of the compressed air connection 15 of the 5/2-way valve 12 in the valve arrangement according to FIG. 3. This embodiment of the valve arrangement according to the disclosure therefore provides combined protection against various fault situations which are conceivable in connection with a spring fracture in the pilot-control valve 13 and also additionally a simultaneously failure of the check valve 18. In the event of a spring fracture only in the pilot-control valve 13, the check valve 18 prevents influencing of the left-hand chamber of the pneumatic working cylinder 3 by means of the control line 16 and the 5/2-way valve 4 which is in the inoperative position. In the event of a simultaneous fault in (failure of) the check valve 18, it is ensured during driving of a piston rod cylinder (with a piston rod formed on one side of the piston) that the piston rod is extended only at a reduced speed because the cross-sectional constriction 22 is arranged upstream of the compressed air connection 15 of the 5/2-way valve 12.

Figure 4:
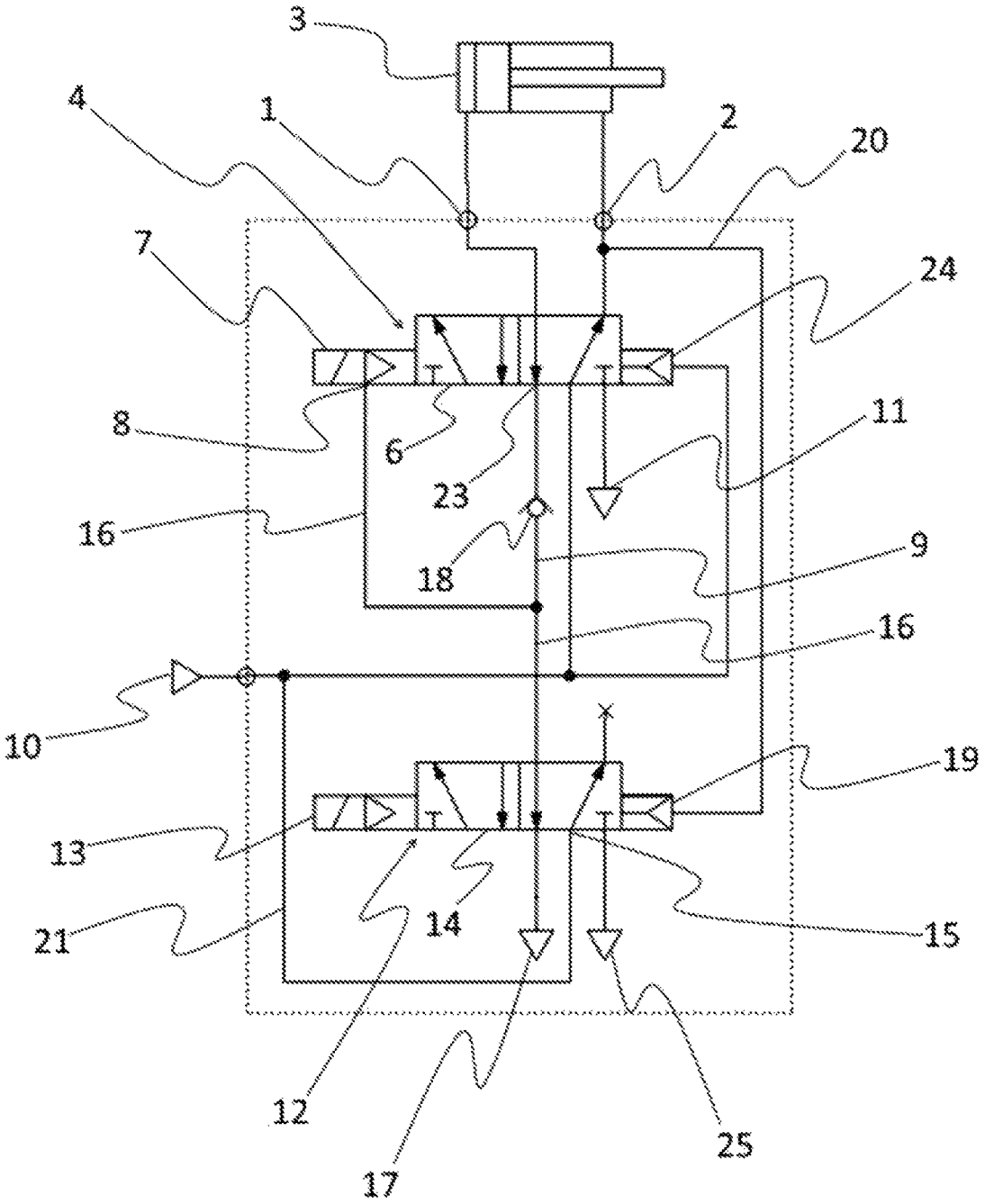
FIG. 4 shows a schematic circuit diagram of a valve arrangement according to the disclosure in line with a fourth exemplary embodiment.

FIG. 4 shows an alternative exemplary embodiment of the valve arrangement according to the disclosure in the unoperated (unenergized) initial position with all of the valves in their inoperative position. In contrast to the valve arrangement according to FIG. 1, in the valve arrangement which is otherwise identical to the valve arrangement according to FIG. 1, firstly the resetting device of the 5/2-way valve 4 is not designed as a mechanical spring, but rather as an air spring 24 which is externally constantly influenced by the pressure medium source 10. In this embodiment, the risk of a spring fracture in the resetting device of the main stage 6 is additionally precluded. Secondly, in contrast to the valve arrangement according to FIGS. 1 to 3, the pilot-control valve 13 does not draw the control pressure, which is required for operating the actuating element of the main stage 14, internally by means of the compressed air connection 15, but rather externally from the compressed air source 10. Valve construction with two identical valve types is possible in this way. In this case, the external control air supply of the pilot-control valve 13 is likewise not switched, but rather constantly externally connected to the compressed air source 13. This is not relevant to the manner of operation of the valve arrangement, but leads to the possibility of using identical parts (here the valves 4 and 12) during production. The manner of operation, which is relevant within the meaning of the application, of the valve arrangement according to FIG. 4 is otherwise identical to the manner of operation of the valve arrangement according to FIG. 1.

Figure 5:
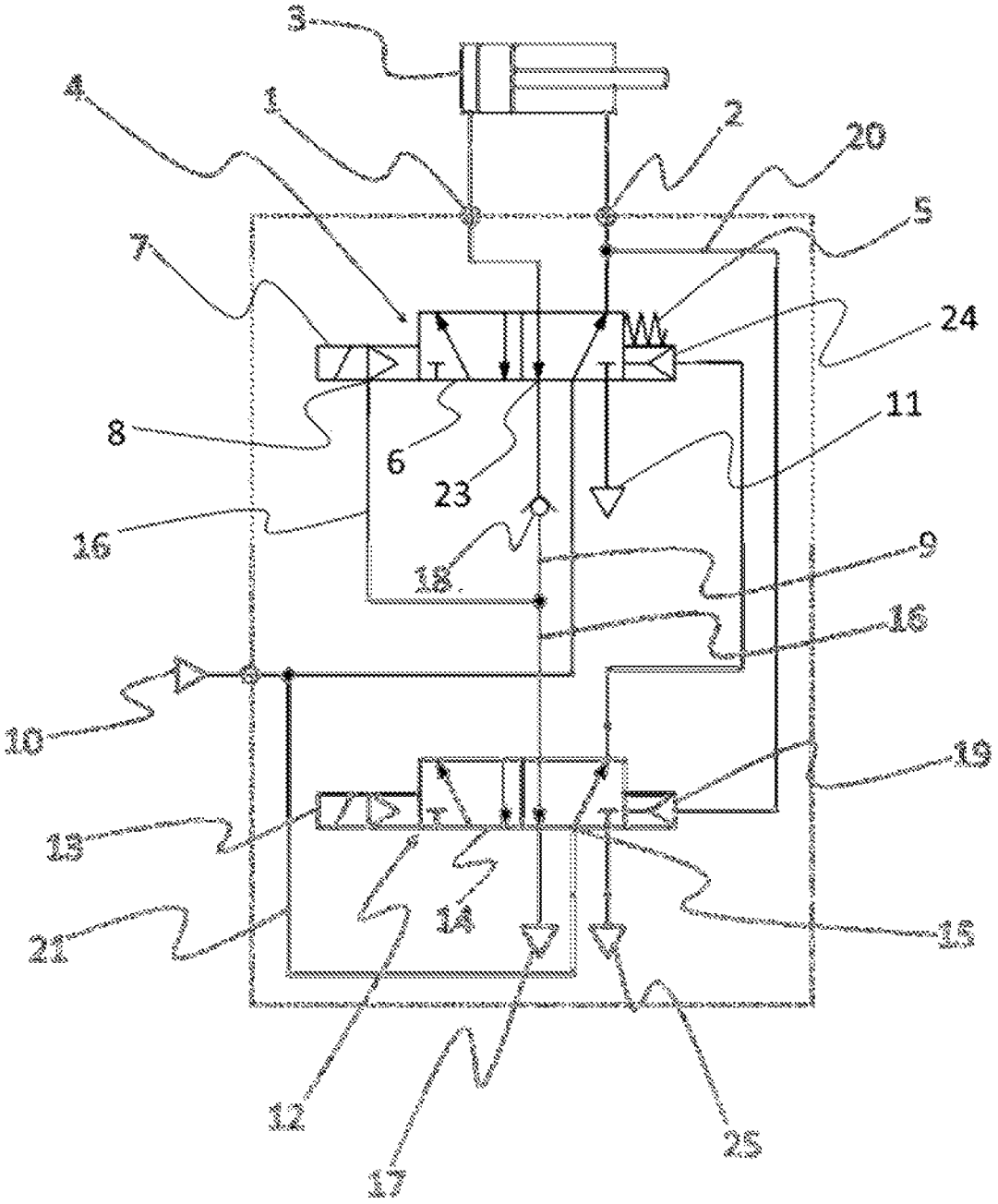
FIG. 5 shows a schematic circuit diagram of a valve arrangement according to the disclosure in line with a fifth exemplary embodiment.

FIG. 5 shows an alternative exemplary embodiment of the valve arrangement according to the disclosure in the (unoperated) unenergized initial position with all of the valves in their inoperative position. In contrast to the valve arrangement according to FIG. 1, in the valve arrangement which is otherwise identical to the valve arrangement according to FIG. 1, the resetting device of the 5/2-way valve 4 is additionally designed parallel to the mechanical spring 5 with the air spring 24 which is influenced externally by means of the 5/2-way valve 12 in its inoperative position and is vented in its switching position by means of the compressed air output 25. This embodiment serves to increase the vibrational and operational stability of the valve arrangement by way of the resetting force, which is exerted on the 5/2-way valve 4, being increased by the two parallel resetting devices. Furthermore, this embodiment provides additional safety in the event of a fracture of the spring 5 of the main stage 6 in which the resetting is still ensured by the air spring 24. The manner of operation, which is relevant within the meaning of the application, of the valve arrangement according to FIG. 5 is otherwise identical to the manner of operation of the valve arrangement according to FIG. 1.

Figure 6:
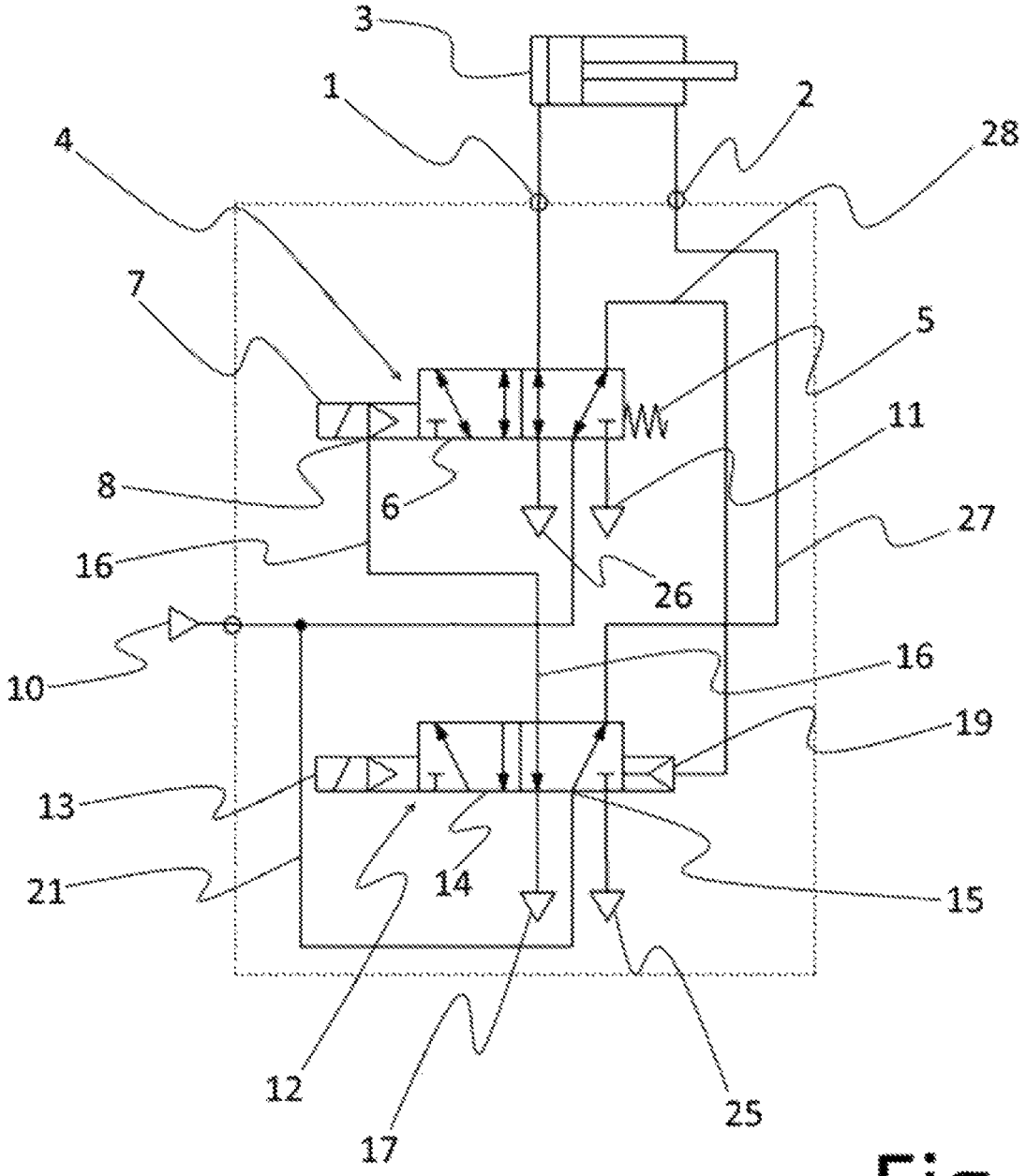
FIG. 6 shows a schematic circuit diagram of a valve arrangement according to the disclosure in line with a sixth exemplary embodiment.

FIG. 6 shows an alternative exemplary embodiment of the valve arrangement according to the disclosure in the unoperated (unenergized) initial position with all of the valves in their inoperative position. The valve arrangement has duct guidance which is modified in comparison with the valve arrangement according to FIG. 1, with the construction otherwise being identical. The first electropneumatically pilot-controlled 5/2-way valve 4 is arranged upstream of the first working connection 1 and, in the inoperative position, connects said first working connection to the compressed air output 26 and, in the switching position, connects said first working connection to the compressed air source 10. The second electropneumatically pilot-controlled 5/2-way valve 12 is arranged upstream of the second working connection 2 and, in the inoperative position, connects said second working connection to the compressed air source 10 and, in the switching position, connects said second working connection to the compressed air output 25 via the supply line 27. The air spring 19 is influenced externally by means of the 5/2-way valve 4 in its inoperative position via the feed line 28. In this embodiment, it is possible to dispense with both the arrangement of a check valve in the connecting line 9 and also a throttle device which is arranged upstream of the compressed air connection 15 of the second 5/2-way valve 12, while maintaining the desired safety features, on account of the modified duct guidance. Owing to the redundant arrangement, both the pilot-control valve 7 of the first 5/2-way valve 4, which pilot-control valve is designed with the external control connection 8, and also the pilot-control valve 13 of the second 5/2-way valve 12 have to switch so that a change in state (opposite venting/influencing) occurs at the two working connections 1 and 2. A fault in the resetting device of one the two pilot-control valves 7 or 13 (for example a spring fracture) cannot lead to an unintended movement of a pneumatic drive which is connected to the working connections 1 and 2. In the event of a spring fracture in the pilot-control valve 13, no change in state (opposite venting/influencing) occurs at the two working connections 1 and 2 because the pilot-control valve 7 does not switch without an electrical control signal. A spring fracture in the pilot-control valve 13 can lead to switching of its main stage 14, but this only leads to additional venting of the second working connection 2 as well. In this case, the first working connection 1 continues to be vented by means of the first 5/2-way valve 4 which remains in its inoperative position. The working cylinder 3 which is connected to the two working connections 1 and 2 stays in its position. No change in state (opposite venting/influencing) occurs at the two working connections 1 and 2 in the event of a spring fracture in the pilot-control valve 7 either because no control pressure is applied to the pilot-control valve 7 since the second 5/2-way valve 12 does not switch without an electrical control signal. The first working connection 1 continues to be vented by means of the first 5/2-way valve 4 which remains in its inoperative position; the second working connection 2 is influenced by means of the second 5/2-way valve 12. The working cylinder 3 which is connected to the two working connections 1 and 2 stays in its position. In this embodiment, the valve arrangement furthermore also has the further advantage that a fault in the resetting device of one the two pilot-control valves 7 or 13 (for example a spring fracture) is reliably identified during operation in each case. In these fault situations, a pneumatic drive which is connected to the working connections 1 and 2 would not reverse again when the electrical control signals are removed. This is because, on account of the crosswise interconnection of the two 5/2-way valves 4 and 12, both pilot-control valves 7 and 13 also always have to switch back so that a renewed change in state (opposite venting/influencing) can occur at the working connections 1 and 2. If only the 5/2-way valve 4 switches back to its inoperative position again, after previously assuming the switching position, when the electrical input signal is removed (=spring fracture in the pilot-control valve 13), the pneumatic working cylinder 3 cannot be retracted because the second working connection 2 is still vented by means of the second 5/2-way valve 12 and the compressed air output 25. The main stage 14 of the 5/2-way valve 12 cannot switch back in spite of influencing of the air spring 19 because a control pressure which counteracts the main stage 14 is still applied by means of the defective pilot-control valve 13, which draws the control pressure internally by means of the compressed air connection 15. In this case, the first working connection 1 is also vented by means of the 5/2-way valve 4 which has returned to its inoperative position. The pneumatic working cylinder 3 remains extended. In the converse case (=spring fracture in the pilot-control valve 7), neither the 5/2-way valve 4 nor the 5/2-way valve 12 switch because they block each other. The main stage 6 of the 5/2-way valve 4 cannot switch back as long as the 5/2-way valve 12 has not switched back because a control pressure, which counteracts the spring-loaded main stage 6, is still applied by means of the defective pilot-control valve 7. In turn, the main stage 14 of the 5/2-way valve 12 cannot switch back as long as the main stage 6 of the 5/2-way valve 4 has not switched back because the air spring 19 does not build up any pressure. Since no renewed change in state occurs at the working connections 1 and 2, the pneumatic working cylinder 3 remains extended and the fault is identified. The first working connection 1 continues to be influenced by means of the first 5/2-way valve 4 and the second working connection continues to be vented by means of the second 5/2-way valve 12. Since no renewed change in state (opposite venting/influencing) therefore occurs at the working connections 1 and 2, the pneumatic working cylinder 3 cannot return and the fault is identified. In this embodiment as well, the resetting device of the main stage 6 of the 5/2-way valve 4 can additionally be designed parallel to the mechanical spring 5 with the air spring in accordance with the embodiment according to FIG. 5. To this end, this air spring is connected to the supply line 27 via a branch and is likewise influenced externally by means of the 5/2-way valve 12 in its inoperative position and vented in its switching position by means of the compressed air output 25.

Figure 7:
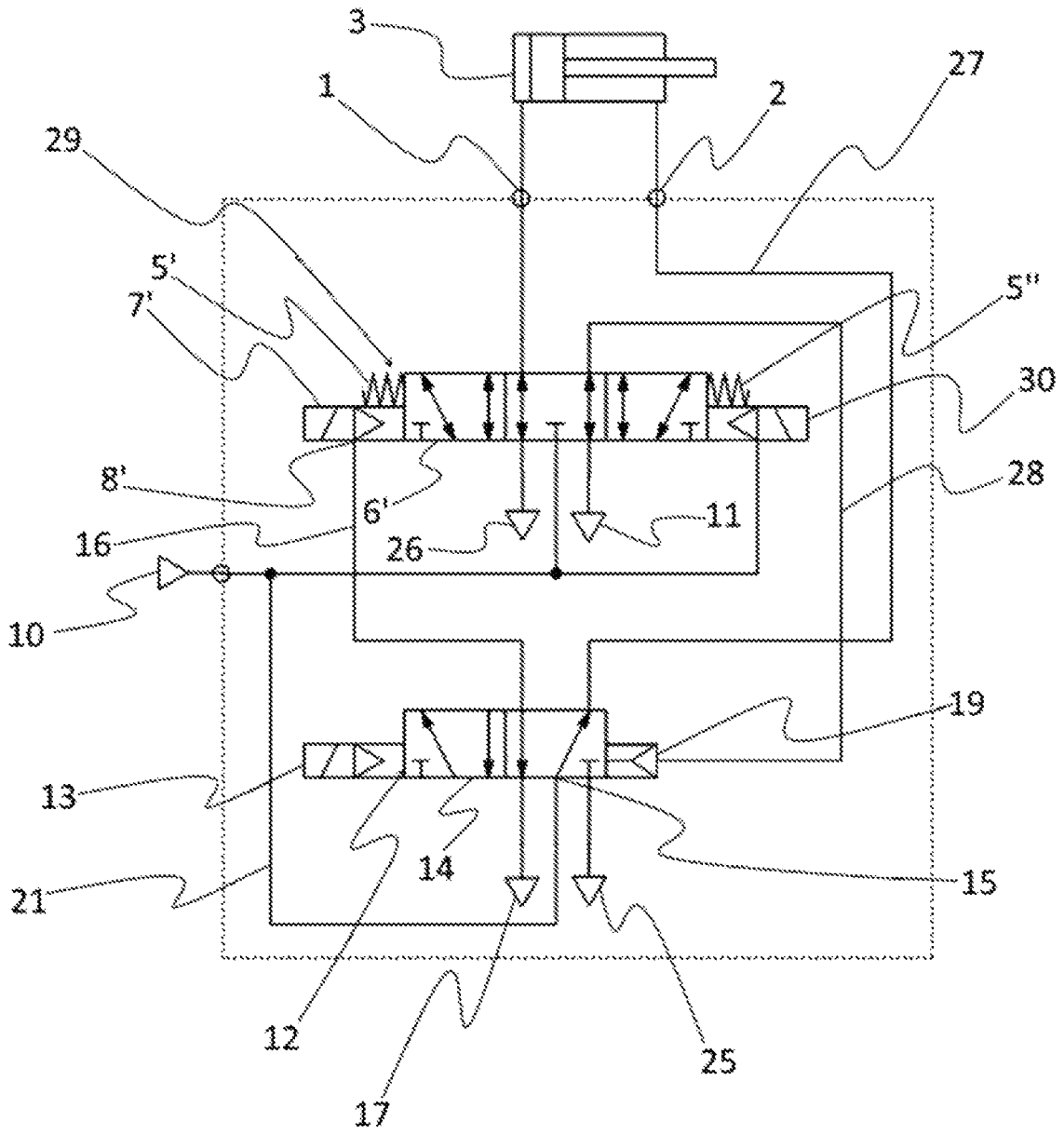
FIG. 7 shows a schematic circuit diagram of a valve arrangement according to the disclosure in line with a seventh exemplary embodiment.

FIG. 7 shows an alternative exemplary embodiment of the valve arrangement according to the disclosure in the unoperated (unenergized) initial position with all of the valves in their inoperative position. In contrast to the valve arrangement according to FIG. 6, in the valve arrangement which is otherwise identical to the valve arrangement according to FIG. 6, the first electropneumatically pilot-controlled valve is configured as a both-way electropneumatically pilot-controlled 5/3-way valve 29 with a both-way automatically resetting main stage and is designed for assuming a vented central position, as the inoperative position, and also a first and a second switching position, wherein the first switching position is assumed in the event of operation and influencing of the pilot-control valve 7' which is designed with the external control connection 8'. The 5/3-way valve 29 is arranged upstream of the first working connection 1 and, in the first switching position (switching of the pilot-control valve 7'), connects said first working connection to the compressed air source 10 and, in the second switching position (switching of the pilot-control valve 30) and the inoperative position, connects said first working connection to the compressed air output 26. The electropneumatically pilot-controlled 5/2-way valve 12 is arranged upstream of the second working connection 2 and, in the inoperative position, connects said second working connection to the compressed air source 10 and, in the switching position, connects said second working connection to the compressed air output 25 via the supply line 27. The air spring 19 of the 5/2-way valve 12 is influenced externally by means of the 5/3-way valve 29 in its second switching position (switching of the pilot-control valve 30) via the feed line 28 and is vented in its first switching position (switching of the pilot-control valve 7') and inoperative position. In this embodiment—as in the embodiment according to FIG. 6 as well—it is possible to dispense with the arrangement of a check valve in the connecting line 9 and also a throttle device which is arranged upstream of the compressed air connection 15 of the second 5/2-way valve 12, while maintaining the desired safety features, on account of the modified duct guidance. Owing to the redundant arrangement, both the pilot-control valve 7' of the 5/3-way valve 29, which pilot-control valve is designed with the external control connection 8', and also the pilot-control valve 13 of the second 5/2-way valve 12 have to switch so that a change in state (opposite venting/influencing) occurs at the two working connections 1 and 2. A fault in the resetting device of one the two pilot-control valves 7' or 13 (for example a spring fracture) cannot lead to an unintended movement of a pneumatic drive which is connected to the working connections 1 and 2 in the initial position. In the event of a spring fracture in the pilot-control valve 13, no change in state (opposite venting/influencing) occurs at the two working connections 1 and 2 because the pilot-control valve 7' does not switch without an electrical control signal. A spring fracture in the pilot-control valve 13 can lead to switching of its main stage 14, but this only leads to additional venting of the second working connection 2 as well by means of the compressed air output 25. In this case, the first working connection 1 continues to be vented by means of the 5/3-way valve 29 which remains in its inoperative position. The working cylinder 3 which is connected to the two working connections 1 and 2 stays in its position. No change in state (opposite venting/influencing) occurs in the initial position at the two working connections 1 and 2 in the event of a spring fracture in the pilot-control valve 7' either because no control pressure is applied to the pilot-control valve 7' since the second 5/2-way valve 12 does not switch without an electrical control signal. The first working connection 1 continues to be vented by means of the 5/3-way valve 29 which remains in its inoperative position; the second working connection 2 is influenced by means of the second 5/2-way valve 12. The working cylinder 3 which is connected to the two working connections 1 and 2 stays in its position. In this embodiment, the valve arrangement furthermore also has the further advantage that a fault in the resetting device of one the two pilot-control valves 7' or 13 (for example a spring fracture) is reliably identified during operation in each case. In these fault situations, a pneumatic drive which is connected to the working connections 1 and 2 would not reverse again when the electrical control signals are removed. This is because, on account of the crosswise interconnection of the two directional valves 29 and 12, both pilot-control valves 7' and 13 also always have to change their previously assumed switching state so that a renewed change in state (opposite venting/influencing) can occur at the working connections 1 and 2 and the drive can reverse again. If only the 5/3-way valve 29 switches back to its inoperative position (the vented central position) again, after previously assuming the switching position, when the electrical input signal is removed (=spring fracture in the pilot-control valve 13), the pneumatic working cylinder 3 cannot be retracted because the second working connection 2 is still vented by means of the second 5/2-way valve 12 and the compressed air output 25. The main stage 14 of the 5/2-way valve 12 cannot switch back in spite of influencing of the air spring 19 because a control pressure which counteracts the main stage 14 is still applied by means of the defective pilot-control valve 13, which draws the control pressure internally by means of the compressed air connection 15. In this case, the first working connection 1 is also vented by means of the 5/3-way valve 29 which has returned to its inoperative position (the vented central position). The pneumatic working cylinder 3 remains extended. In the converse case (=spring fracture in the pilot-control valve 7'), neither the 5/3-way valve 29 nor the 5/2-way valve 12 switch because they block each other. The main stage 6' of the 5/3-way valve 29 cannot switch back as long as the 5/2-way valve 12 has not switched back because a control pressure, which counteracts the spring-loaded main stage 6', is still applied by means of the defective pilot-control valve 7'. In turn, the main stage 14 of the 5/2-way valve 12 cannot switch back as long as the main stage 6' of the 5/3-way valve 29 has not switched back to its second switching position (switching of the pilot-control valve 30) because the air spring 19 does not build up any pressure. Since no renewed change in state occurs at the working connections 1 and 2, the pneumatic working cylinder 3 remains extended and the fault is identified. The first working connection 1 continues to be influenced by means of the first 5/3-way valve 29 and the second working connection continues to be vented by means of the second 5/2-way valve 12. Since no renewed change in state (opposite venting/influencing) therefore occurs at the working connections 1 and 2, the pneumatic working cylinder 3 cannot return and the fault is identified. On account of the identical duct guidance in the case of the design as a modular structural unit with a base plate and valve modules or valve bodies which are mounted on said base plate, the valve arrangements of FIG. 6 and FIG. 7 can be produced with the same base plate. This renders possible the use of identical parts for the base plate when producing the two valve arrangements of FIGS. 6 and 7. The different valve function is provided solely by the different configuration of the first directional valve which can be replaced by exchange for an identical base plate.

Figure 8:
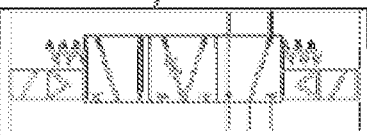
FIG. 8 shows a tabular representation of switching positions of the valve arrangement according to FIG. 2 in comparison with the switching positions of a 5/3-way valve with an open central position.
Figure 8:
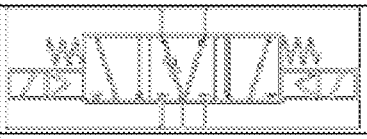
Figure 8:
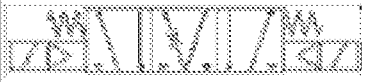
Figure 8:
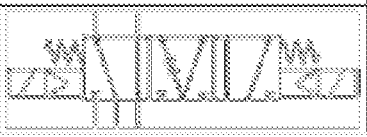

FIG. 8 shows a tabular representation of switching positions of the valve arrangement according to FIG. 2 in comparison with the switching positions of a commercially available both-way electropneumatically pilot-controlled 5/3-way valve 29' with an open central position (both working connections influenced). By way of the pilot-control valves 7 and 13 of the valve arrangement according to FIG. 2 both being of jointly and also individually electrically switchable design, an additional valve function is achieved with the control positions rendered possible as a result. The possible control positions are illustrated in the rows of the table in FIG. 8, wherein the entries in the first column identify the respective switching positions of the pilot-control valve 7 and the entries in the second column identify the respective switching positions of the pilot-control valve 13, both with respect to the embodiment of the valve arrangement according to FIG. 2. The entry "On" in each case identifies the operation of the corresponding pilot-control valve, as a result of which the directional valve which is subjected to pneumatic pilot control by said pilot-control valve assumes its switching position. The entry "Off" in each case identifies the non-operation of the corresponding pilot-control valve, as a result of which the directional valve which is subjected to pneumatic pilot control by said pilot-control valve assumes its inoperative position. With respect to the working connections 1 and 2, the valve arrangement according to FIG. 2 can be controlled overall in accordance with the manner of operation of a commercially available 5/3-way valve 29' with an open central position (both working connections influenced) with these control positions. The switching states of a 5/3-way valve 29' which respectively correspond to the control positions of the valve arrangement according to FIG. 2 indicated in FIG. 8 are illustrated in the third column and briefly described in the fourth column. The control position of the valve arrangement according to FIG. 2 which corresponds to the 5/3-way valve 29' in its open central position (this is the inoperative position of the 5/3-way valve 29', both pilot stages are inactive) is illustrated in the second row of the table FIG. 8 here. In this case, only the pilot-control valve 13 is operated, wherein the 5/2-way valve 12 assumes its switching position (while the first 5/2-way valve 4 is in the inoperative position).

Figure 9:
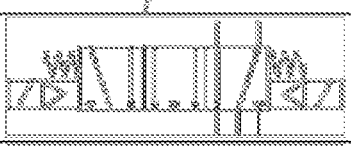
FIG. 9 shows a tabular representation of switching positions of the valve arrangement according to FIG. 6 in comparison with the switching positions of a 5/3-way valve with a vented central position.
Figure 9:
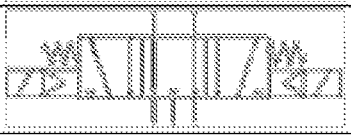
Figure 9:
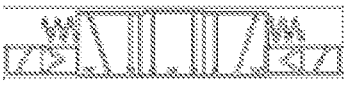
Figure 9:
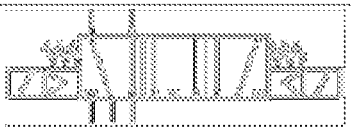
Figure 10:
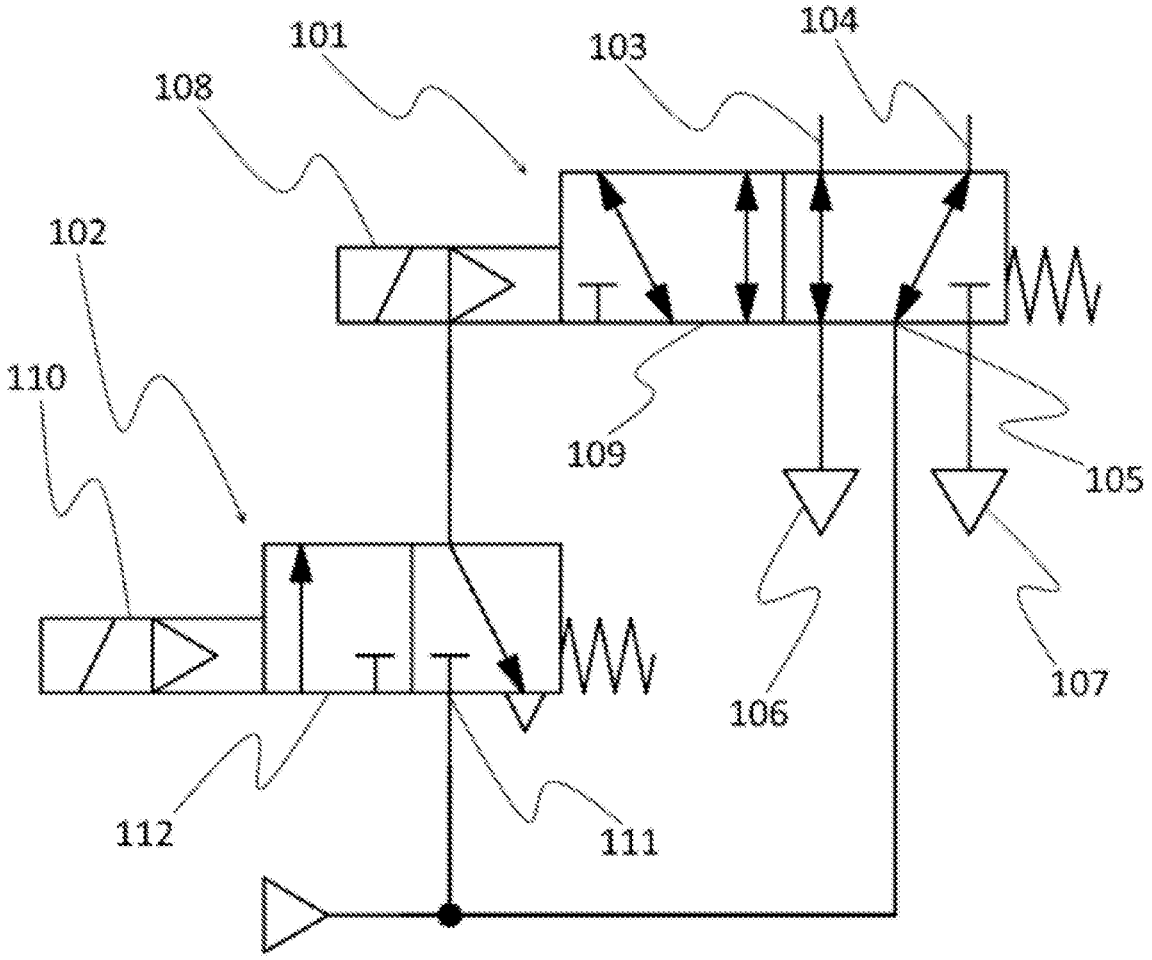
(Prior art) Fig. 10
FIG. 10 shows a schematic circuit diagram of a known valve arrangement (prior art).

FIG. 9 shows a tabular representation of switching positions of the valve arrangement according to FIG. 6 in comparison with the switching positions of a commercially available both-way electropneumatically pilot-controlled 5/3-way valve 29" with a vented central position. By way of the pilot-control valves 7 and 13 of the valve arrangement according to FIG. 6 both being of jointly and also individually electrically switchable design, an additional valve function is achieved with the control positions rendered possible as a result. The possible control positions are illustrated in the rows of the table FIG. 9, wherein the entries in the first column identify the respective switching positions of the pilot-control valve 7 and the entries in the second column identify the respective switching positions of the pilot-control valve 13, both with respect to the embodiment of the valve arrangement according to FIG. 6. The entry "On" in each case identifies the operation of the corresponding pilot-control valve, as a result of which the directional valve which is subjected to pneumatic pilot control by said pilot-control valve assumes its switching position. The entry "Off" in each case identifies the non-operation of the corresponding pilot-control valve, as a result of which the directional valve which is subjected to pneumatic pilot control by said pilot-control valve assumes its inoperative position. With respect to the working connections 1 and 2, the valve arrangement according to FIG. 6 can be controlled overall in accordance with the manner of operation of a commercially available 5/3-way valve 29" with a vented central position (both working connections vented) with these control positions. The switching states of a 5/3-way valve 29" which respectively correspond to the control positions of the valve arrangement according to FIG. 6 indicated in FIG. 9 are illustrated in the third column and briefly described in the fourth column. The control position of the valve arrangement according to FIG. 6 which corresponds to the 5/3-way valve 29" in its vented central position (this is the inoperative position of the 5/3-way valve 29", both pilot stages are inactive) is illustrated in the second row of the table FIG. 9 here. In this case, only the pilot-control valve 13 is operated, wherein the 5/2-way valve 12 assumes its switching position (while the first 5/2-way valve 4 is in the inoperative position).

LIST OF REFERENCE SYMBOLS

1 First working connection
2 Second working connection
3 Working cylinder

4, 12 5/2-way valve
5, 5', 5" Spring
6, 6', 14, 109, 112 Main stage
7, 7', 13, 30, 108, 110 Pilot-control valve
8, 8' Control connection
9 Connecting line
10 Compressed air source
11, 17, 25, 26 106, 107 Compressed air output
15, 105, 111 Compressed air connection
16 Control line
18 Check valve
19, 24 Air spring
20, 28 Feed line
21, 27 Supply line
22 Cross-sectional constriction
23 Valve connection
101, 102 Valve
103, 104, 111 Working connection
29, 29', 29" 5/3-way valve

The invention claimed is:

1. A valve arrangement, comprising:

a first and a second working connection connected to a pneumatic drive, and a first and a second electropneumatically pilot-controlled directional valve, wherein at least one of the first and the second directional valves is arranged upstream of the first and the second working connections for the purpose of influencing and venting said first and said second working connections, wherein pilot stages of both directional valves are of automatically resetting design and the second directional valve is designed for alternately assuming an inoperative position and a switching position and the pilot stage of the first directional valve has an external control connection which can be influenced by means of the second directional valve in the switching position of the second directional valve and can be vented by means of said second directional valve in the inoperative position of the second directional valve, wherein the second directional valve has, as a resetting device for a main stage, an air spring configured to be influenced and vented externally by means of the first directional valve, and a change in state between influencing or venting of the air spring of the second directional valve after the first directional valve assumes a switching position takes place only depending on the change in the switching state of the first directional valve, and a change in state between influencing or venting at one of the two working connections after previous influencing or venting which took place with the second directional valve assuming the switching position takes place only depending on the second directional valve assuming the inoperative position.

2. The valve arrangement as claimed in claim 1, wherein main stages of the two directional valves are configured with a spool construction and/or the pilot stages of the two directional valves are configured with a seat-type construction.

3. The valve arrangement as claimed in claim 1, wherein the first directional valve is designed for alternately assuming an inoperative position and the switching position with an automatically resetting main stage, characterized in that the second directional valve connects the external control connection of the first directional valve, in the switching position of the second directional valve, to a compressed air source via a control line and, in the inoperative position of the second directional valve, to a compressed air output and the air spring of the second directional valve is influenced by means of the first directional valve in the inoperative position of the first directional valve and is vented by means of said first directional valve in the switching position of the first directional valve, and wherein the first directional valve is arranged upstream of the two working connections and, in the switching position, connects the first working connection to the compressed air source and connects the second working connection to a compressed air output and, in the inoperative position, connects the second working connection to the compressed air source and connects the first working connection to the control line via a connecting line, wherein a check valve which provides blocking in the opposite direction is arranged in the connecting line and/or a throttle device is or are arranged upstream of a compressed air connection of the second directional valve.

4. The valve arrangement as claimed in claim 3, wherein the resetting device of the main stage of the first directional valve is designed parallel with a mechanical spring and a second air spring, wherein the second air spring is influenced externally by means of the second directional valve in the inoperative position of the second directional valve and is vented in the switching position of the second directional valve.

5. The valve arrangement as claimed in claim 3, wherein the throttle device is arranged upstream of the compressed air connection of the second directional valve and there is no check valve arranged in the connecting line, characterized in that the pilot stages of the two directional valves are both of jointly and also individually electrically switchable design.

6. The valve arrangement as claimed in claim 1, wherein the second directional valve is configured as a 3/2-way valve.

7. The valve arrangement as claimed in claim 1, wherein the second directional valve is configured as a 4/2-way valve.

8. The valve arrangement as claimed in claim 1, wherein the first directional valve is designed for alternately assuming an inoperative position and the switching position with an automatically resetting main stage, characterized in that the second directional valve connects the external control connection of the first directional valve, in its switching position of the second directional valve, to a compressed air source via a control line and, in the inoperative position, to a compressed air output and the air spring of the second directional valve is influenced by means of the first directional valve in the inoperative position of the first directional valve and is vented by means of said first directional valve in the switching position of the first directional valve, and wherein the first directional valve is arranged upstream of the first working connection and, in the switching position, connects said first working connection to the compressed air source and, in the inoperative position, connects said first working connection to a second compressed air output, and wherein the second directional valve is arranged upstream of the second working connection and, in the inoperative position, connects said second working connection to the compressed air source and, in the switching position, connects said second working connection to a third compressed air output.

9. The valve arrangement as claimed in claim 8, wherein the pilot stages of the two directional valves are of both jointly and also individually electrically switchable design.

10. The valve arrangement as claimed in claim 1, wherein the first directional valve is configured as a 5/2-way valve.

11. The valve arrangement as claimed in claim 1, in which the first directional valve is configured as a both-way electropneumatically pilot-controlled 5/3-way valve with a both-way automatically resetting main stage and is designed for assuming a vented central position, as an inoperative position, and also a first and a second switching position, wherein the first switching position is assumed in the event of operation and influencing of the pilot stage of the first directional valve which is designed with the external control connection, characterized in that the second directional valve connects the external control connection of the first directional valve, in the switching position of the second directional valve, to a compressed air source via a control line and, in the inoperative position of the second directional valve, to a compressed air output and its air spring is influenced by means of the first directional valve in the second switching position of the first directional valve and is vented by means of said first directional valve in the first switching position of the first directional valve and inoperative position, and wherein the first directional valve is arranged upstream of the first working connection and, in the first switching position, connects said first working connection to the compressed air source and, in the second switching position and the inoperative position, connects said first working connection to a second compressed air output, and wherein the second directional valve is arranged upstream of the second working connection and, in the inoperative position, connects said second working connection to the compressed air source and, in the switching position, connects said second working connection to a third compressed air output.

12. The valve arrangement as claimed in claim 1, wherein the second directional valve is configured as a 5/2-way valve.

* * * * *